US006425354B1

(12) United States Patent
Büchel et al.

(10) Patent No.: US 6,425,354 B1
(45) Date of Patent: Jul. 30, 2002

(54) PORTABLE, COMBUSTION-ENGINED TOOL AND A METHOD OF CONTROLLING THE TOOL OPERATION

(75) Inventors: Franz Büchel, Ruggell (LI); Stefan Bönig; Joachim Thieleke, both of Wasserburg (DE); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/741,289

(22) Filed: Dec. 19, 2000

(30) Foreign Application Priority Data

Dec. 23, 1999 (DE) ..... 199 62 598

(51) Int. Cl.[7] ..... B25C 1/08
(52) U.S. Cl. ..... 123/46 R
(58) Field of Search ..... 123/46 R, 46 SC; 227/10, 9, 8

(56) References Cited

U.S. PATENT DOCUMENTS 5,199,626 A * 4/1993 Terayama et al. ..... 123/46 SC

* cited by examiner

*Primary Examiner*—Marguerite McMahon
*Assistant Examiner*—Hyder Ali
(74) *Attorney, Agent, or Firm*—Sidley Austin Brown & Wood, LLP

(57) ABSTRACT

A method of controlling operation of a portable, combustion-engined tool including a combustion chamber (1) an inlet/outlet valve (26) of which is closed or is opened dependent on an operational phase of the tool, with the method including igniting a fuel gas mixture filling the combustion chamber (1) for build-up of gas pressure therein and closing or opening the inlet/outlet valves (26) dependent on the gas pressure developed in the combustion chamber (1), and a tool in which the method is implemented.

7 Claims, 5 Drawing Sheets

PORTABLE, COMBUSTION-ENGINED TOOL AND A METHOD OF CONTROLLING THE TOOL OPERATION

BACKGROUND OF THE INVENTION

1. Field of the Invention

The present invention relates to a portable, combustion-engined tool, in particular a setting tool for driving in fastening elements and including a combustion chamber an inlet/outlet valve of which is closed or opened dependent on an operational phase of the tool, and to a method of controlling the operation of such a tool.

2. Description of the Prior Art

In the tool described above, a drive energy is obtained by combustion of a fuel gas mixture and is transmitted by a piston to a fastening element. By pressing the tool against an object in which the fastening element is to be driven in, an ignition of the fuel gas mixture in the combustion chamber is initiated. The initiation of the ignition takes place upon actuation of an ignition device by a trigger which is actuated upon the tool being pressed against the object. The ignition device produces an electrical spark that ignites the fuel gas mixture, starting a combustion process. The increased pressure, which is produced by the combustion of the fuel gas mixture, acts on the piston which adjoins the combustion chamber, driving the same in the setting direction. At the end of its displacement in the setting direction, the piston passes past outlet openings which are formed in a guide cylinder, in which the piston is located, and through which opening exhaust or waste gases can be at least partially removed. The piston then returns to its initial position as a result of an underpressure created in the combustion chamber as a result of cooling down of residual gases still remaining in the combustion chamber. During the time the piston returns to its initial position, the combustion chamber should remain sealed from the surrounding environment. The inlet/outlet valve, through which fresh air enters the combustion chamber, should open only after the return movement of the piston has been completed. Generally, the time necessary for return of the piston to its initial position, increases with an increase of the tool temperature. In addition, a high-energy tool requires that a large expansion volume be available, which also increases the time of the return movement of the piston.

In conventional tools, the inlet/outlet valve can be closed with an appropriate latch fixedly connected with a trigger by a toggle lever. The inlet/outlet valve becomes open as soon as the trigger, which is associated with the piston, returns to its initial position.

The locking of the inlet/outlet valve with a trigger means that the shift point of the trigger cannot any more be arbitrary selected. The ignition switch can only then be actuated when the closing of the inlet/outlet valve has been completed, i.e., much later after the trigger movement. However, a prolonged trigger movement adversely affects or influences the customer acceptance of such tools. Further, with a hot tool, the return movement of the piston, as it has already been discussed above, takes more time. In this case, the user has to hold the trigger in its pulled position much longer in order to prevent the piston from occupying an erroneous position.

Naturally, in order to increase the time during which the piston returns to its initial position, the movement of the trigger can be damped. However, damping of the trigger movement adversely affects the trigger characteristics as the triggering force is increased, and the trigger itself does not return to its initial position sufficiently rapidly. Users view dampening of a trigger very unfavorably as it reduces the output and increases actuation forces that need be applied by a user.

A further non-insignificant problem consists in that not in each case, return of the piston to its exact initial position is insured.

Accordingly, an object of the present is a tool of the above-described type and a method of controlling its operation which would insure a complete return of the piston to its initial position before the inlet/outlet valve opens, without any manipulation of the trigger by a user.

SUMMARY OF THE INVENTION

This and other objects of the present invention, which will become apparent hereinafter, are achieved by providing a tool having blocking means providing for closing and opening of the inlet/outlet valve, and means for controlling the operation of the blocking means in accordance with the pressure in the combustion chamber; and by providing a method according to which the closing and opening of the inlet/outlet valve is effected dependent on the gas pressure in the combustion chamber.

In this way, the closing of the inlet/outlet valve is automatized and, in addition, ignition of the gas mixture in the combustion chamber takes place independent of the displacement position of the trigger. In this way, it is insured that the piston always returns to its initial position before opening of the inlet/outlet valve. The operation is effected completely automatically, without intervention of the user, in particular, because opening of the inlet/outlet valve is not any more controlled by the trigger movement.

As soon as an overpressure is produced in the combustion chamber after ignition of the fuel gas mixture therein, at least one inlet/outlet valve can be closed (if the combustion chamber has several inlet/outlet valves). This can in principle take place at any overpressure as closing of the inlet/outlet valve(s) alone is not absolutely necessary for displacement of the piston. However, closing should take place in each case after the overpressure in the combustion chamber has been created and the piston has been displaced, as now retaining of the underpressure, which is necessary for return of the piston to its initial position as a result of cooling of the residual gases, should be insured. The combustion chamber, in this case, should not be aerated, and the inlet/outlet valve should remain closed, which requires locking the valve in its closed position. Otherwise, a complete return of the piston to its initial position would not have been possible. To unsure this, closing already starts after the gas pressure have reached a predetermined, relatively small value.

Opening of the inlet/outlet valve takes place after expiration of a predetermined time period after overpressure in the combustion chamber has been produced. The predetermined time period can, e.g., be determined based on previous empirically determined data. At that, the time, necessary for return of the piston to its initial position, should lie within the predetermined time period. It proved advantageous to count the predetermined time period starting from the point the maximum gas pressure in the combustion chamber has been reached, as a maximum gas pressure can be easily achieved in the combustion chamber.

According to the present invention, as soon as the gas overpressure has been detected, somewhat shortly after the beginning of the ignition process, the closing takes place. Then, the time-delay element, which provides for automatic opening after a predetermined time period, is actuated. This time period, as it has already been discussed above, is so selected that opening starts after the piston has been completely returned to its initial position. The return of the piston to its initial position can take place independent of the actuation of the trigger which insures a reliable operation of the tool.

The blocking device can be formed in any arbitrary manner. It only should be insured that it reacts to the inner pressure of the combustion chamber. When the blocking device is formed as an electro-mechanical or purely electrical device, for determining the inner pressure in the combustion chamber, a pressure/voltage transformer can be used. According to the invention, the blocking device can include a pneumatic device, in which case, its operation is initiated directly by the pressure in the combustion chamber.

According to preferred embodiment of the present invention, the blocking device includes a check valve connected with the combustion chamber, and a pneumatic cylinder located downstream of the check valve, with the conduit connecting the check valve with the pneumatic cylinder communicating with the surrounding environment via a throttle. The check valve only permits gas flow from the combustion chamber to the pneumatic cylinder for actuating a piston having a piston rod and displaceable in the pneumatic cylinder. After the over pressure in the combustion chamber reaches its maximum and is them reduced, the check valve closes automatically as the pressure in the conduit, which connects the check valve with the pneumatic cylinder, is greater than in the combustion chamber. The conduit, together with the throttle, forms the time-delay element as the pressure in the conduit is gradually reduced by the throttle. As the pressure in the conduit is reduced, the piston is biased to its initial position by a compression spring located in the cylinder, releasing the blocking member which results in opening of the inlet/outlet valve. The speed of the movement of the piston in the cylinder and the release of the inlet/outlet valve can be selected by adjusting the throttle, whereby the predetermined time period, which is determined by the time necessary for return of the piston into its initial position can be matched to corresponding environmental conditions and/or constructive features of the tool.

The piston rod of the piston of the pneumatic cylinder can, e.g., pivot the blocking member into the displacement path of a drive ring, which is arranged outside of the combustion chamber, for blocking the movement of the drive ring or releasing the drive ring which actuates the inlet/outlet valve. Due to the use of the pivotal blocking member, the dimensions of the entire construction are only slightly increased.

The present invention can be used in tools having a single-volume combustion chamber. However, the invention can also be used in tools having a multi-sectional combustion chamber the chamber sections of which are separated by one or several separation wall(s) or plate(s) provided with a plurality of through-openings. In the later case, the pressure in the chamber section adjoining the piston controls the closing and opening of the inlet/outlet valve or valves. The present invention can also be used with tools having collapsible combustion chambers which include a plurality of chamber sections separated by movable walls which are pushed onto each other during deaeration of the combustion chamber, which results in collapse of the combustion chamber. As long as the aeration/deaeration valve(s) remains closed, and as long as the piston has not yet returned to its initial position, the collapse of the combustion chamber should be prevented, so that the same pressure conditions, which control closing/opening of the inlet/outlet or aeration/deaeration valve, control the locking or release of the movable walls of the combustion chamber.

The novel features of the present invention, which are considered as characteristic for the invention, are set forth in the appended claims. The invention itself, however, both as to its construction and its mode of operation, together with additional advantages and objets thereof, will be best understood from the following detailed description of preferred embodiments, when read with reference to the accompanying drawings.

DETAILED DESCRIPTION OF THE PREFERRED EMBODIMENT

Figure 1:
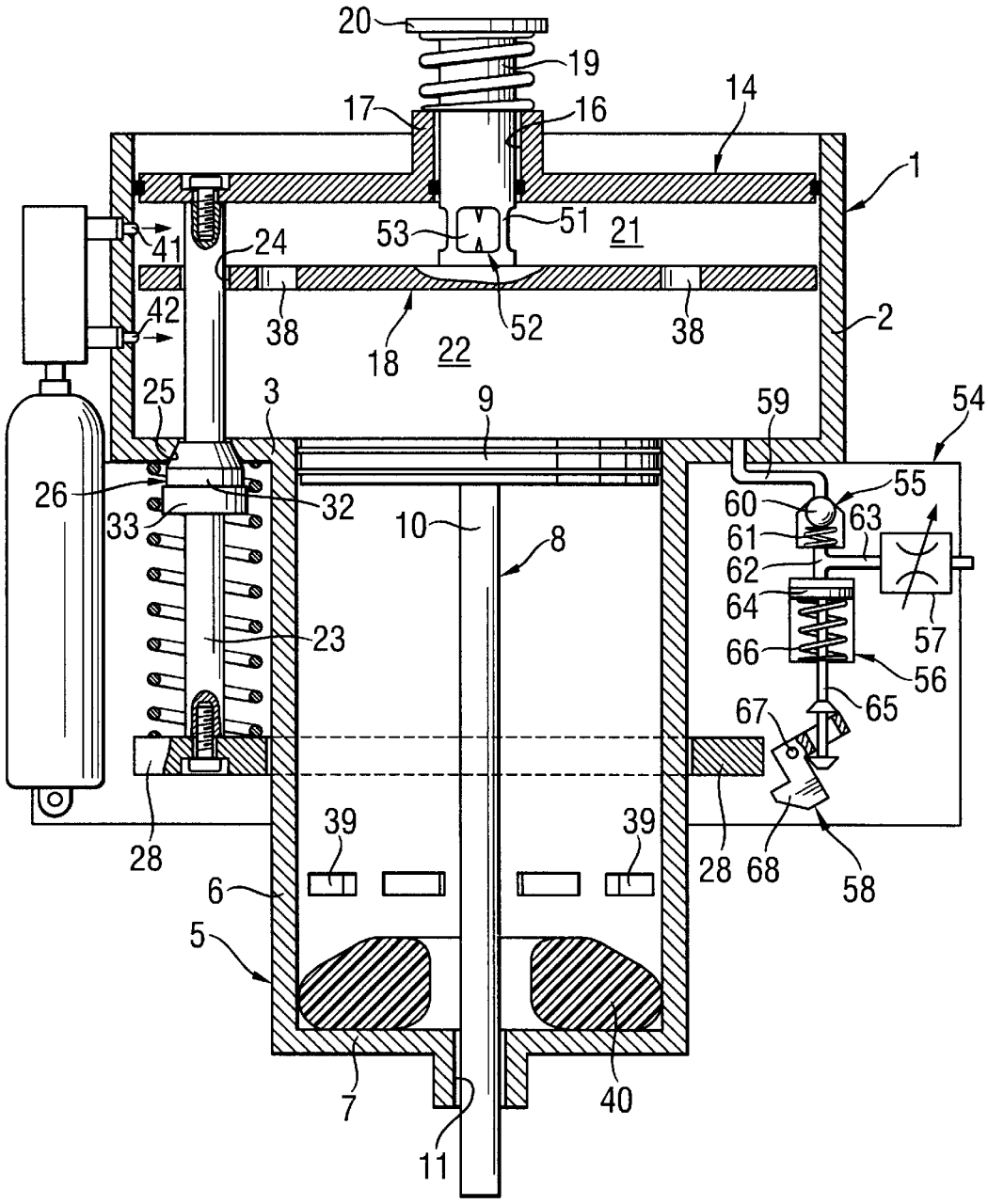
FIG. 1 shows an axial cross-sectional view of a combustion-engined tool according to the present invention in the region of the tool combustion chamber, with completely expanded chamber sections but with the movable walls not yet locked in their positions.

A combustion chamber 1 of the inventive combustion-engined tool, in particular, of a setting tool, which is shown in FIG. 1, has a cylindrical shape and includes a cylindrical wall 2 and a ring-shaped bottom 3 adjoining the cylindrical wall 2. In the center of the bottom 3, there is provided an opening 4. A guide cylinder 5, which as a cylindrical wall 6 and a bottom 7, adjoins the opening 4 in the bottom 3 of the combustion chamber 1. A piston 8 is slidably displaceably arranged in the guide cylinder 5 for displacement in the longitudinal direction of the guide cylinder 5. The piston 8 consists of a piston plate 9 facing the combustion chamber and a piston rod 10 extending from the center of the piston plate 9. The piston rod 10 projects through an opening 11 formed in the bottom 7 of the guide cylinder 5.

FIG. 1 shows a non-operational position of the setting tool in which the piston 8 in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5.

Sealing rings can be provided on opposite sides of the piston plate 9 to seal the chambers on the opposite sides of the piston plate 9 from each other.

Inside of the combustion chamber 1, there is provided a cylindrical plate 14 further to be called a movable combustion chamber wall or movable wall. The plane of the plate 14 extends transverse to the longitudinal direction of the tool. The movable wall 14 is displaceable in the longitudinal direction of the combustion chamber 1. For separating the chambers on opposite sides of the movable wall 14, an annular sealing is provided on the circumference of the movable wall. The movable wall 14 has a central opening 16, with an annular sealing provided in the wall of the opening 16.

Between the movable wall 14 and the annular bottom 3 of the combustion chamber 1, there is provided a separation plate 18. The separation plate 18 has a circular shape and an outer diameter corresponding to the inner diameter of the combustion chamber. The side of the separation plate 18 adjacent to the movable wall 14 is provided with a cylindrical lug 19 that projects through he central opening 16 in the movable wall 14. The length of the lug 19 exceeds the thickness of the movable wall 14 in several times. The annular sealing sealingly engages the outer circumference of the cylindrical lug 19. At its free end, the cylindrical lug 19 is provided with a shoulder 20 the outer diameter of which exceeds the outer diameter of the lug 19 and the inner diameter of the opening 16 of the movable wall 14. At the edge of the opening 16, there is provided a hollow cylindrical projection 17 connected with the movable wall 14. The hollow projection 17 surrounds the lug 19. The free end of the projection 17 is located below the shoulder 20.

In the idle position of the tool, the separation plate 18 lies on the bottom 3, and the movable wall 14 lies on the separation plate 18. The combustion chamber 1 is in its completely collapsed condition. Upon the tool being pressed against an object into which a fastening element is to be driven in, as it would be explained later, the movable wall 14 is lifted and becomes separated from the separation plate 18, moving away therefrom. After a while, the projection 17 engages the shoulder 20 of the lug 19 of the separation plate 18. At that, the movable wall 14 and the separation plate 18 are spaced by a predetermined distance determined by the position of the shoulder 20. The movable wall 14 and the separation plate 18 form together a forechamber 21 which, in effect, is a section of the combustion chamber 1 and which further below will be referred to as a forechamber section 21. Upon further displacement of the movable wall 14, the movable wall 14 and the separation plate 18 move together, so that a further chamber section, which further will be referred to as a main chamber section is formed between the separation plate 18 and the bottom 3 of the piston plate 9. The main chamber section is designated with a reference numeral 22. FIG. 1 shows both chamber sections 21, 22 in their completely expanded condition.

For displacing the movable wail 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25 formed in the bottom 3 of the combustion chamber 1. The openings 25 are formed as ventilation openings and have a conical shape. The movable wall 14 is connected with drive rods 23 by, e.g., screws which extend through the movable wall 14 and are screwed into the drive rods 23. The free ends of the drive rods 23 are connected with each other by a drive ring 28 which is arranged concentrically with the combustion chamber axis and which circumscribes the guide cylinder 5. The drive ring 28 is connected with the drive rods 23 by screws which extend through the drive ring and are screwed into the drive rods 23 through end surfaces of the free ends of respective drive rods 23. Each of the drive rods 23 supports a compression spring extending between the bottom 3 of the combustion chamber 1 and the drive ring 28. The compression springs 30 are designed for pulling the movable wall 14 toward the bottom 3.

As it has already mentioned above, the openings 25 in the bottom 3 of the combustion chamber 1, which also serve as ventilation openings, are conically widened outwardly. A valve tappet 32 sealingly extends into each opening 25. The valve tapped 32 is located, with the opening 25 being open, outside of the combustion chamber 1 or beneath the bottom 3 and is retained there by a shoulder 33 provided on the drive rode 23. When the drive rods 23 are pushed in the direction toward the bottom 3, the shoulders 33 push the valve tappets 32 into the openings 25, closing the valves 26 formed by the walls of the openings 25 and the valve tappets 32. The valve 26 is formed as an inlet/outlet valve. It is to be pointed out that the separation plate 18 has a plurality of opening 38 equidistantly spaced from the axis of the combustion chamber 1. Further, a plurality of openings 39 are provided at the lower end of the guide cylinder 5 for letting air out of the guide cylinder 5 upon movement of the piston 8 toward the guide cylinder bottom 7. At the lower end of the guide cylinder 5, there is also provided damping means 40 for damping the movement of the piston 8. As soon as the piston 8 passes the openings 39, the waste gases are expelled from the guide cylinder 5 through the openings 39.

Two radial through-openings 41, 42 are provided in the cylindrical wall 2 of the combustion chamber 1. Two conduits (not shown), which extend from outside into the through-openings 41, 42, communicate the combustion chamber 1 with a metering valve and provide for injection of, e.g., liquefied fuel gas into respective combustion chamber sections 21, 22 which are formed when the movable wall 14 and the separation wall 18 are displace to their operational end positions.

As it has already been mentioned above, FIG. 1 shows the tool with the chamber sections in their expanded condition, i.e., with the-forechamber section 21 and the main chamber section 22 being expanded. The displacement positions of the movable wall 14 and the separation plate 18 are defined by a stop which is formed by the valve tappets 32. The valve tappets 32, upon being inserted, into the openings 25 form stops for arresting the displacement of the drive rods 23 which are arrested as a result of the shoulders 33 engaging the valve tappets 32. The stoppage of the drive rods 23 results in the stoppage of the movable wall 14. The position of the separation plate 18 is determined by the position of the shoulder 20 which, in turn, is determined by the length of the hollow projection 17 of the movable wall 14.

The lug 19 forms, in its region adjacent to the separation plate 18, an ignition cage 51 for receiving an ignition element 52. The ignition element 52 serves for generating an electrical spark for the ignition of the air-fuel gas mixture in the forechamber section 21. As it will be described in more detail below, the ignition device 52 is located in the central region of the cage 51 having openings 53 formed in the cage circumference. Through this openings 53, a laminar flame front exits from the ignition cage 51 into the forechamber section 21.

As shown in FIG. 1, sidewise of the guide cylinder 5, there is located a blocking device 54.

The blocking device 54 has a check valve 55, a pneumatic cylinder 56, a throttle 57, and a pivotal blocking hook 58. The check valve 55 is a one-way valve and is connected with fluid conduit 59 extending through the bottom 3 and opening into the combustion chamber 1. The check valve 55 provides for gas flow only from the combustion chamber 1 and includes a ball 60 for blocking the conduit 59. The ball 60 is biased into its blocking position by a spring 61. The outlet side of the check valve 55 is connected by a channel 62 with an inlet of the pneumatic cylinder 56. The channel 62 is connected with a branch channel in which the throttle 57, which is adjustable, is provided. Inside the pneumatic cylinder 56, there is located a piston 64. The piston 64 is connected with a piston rod 65 projecting out of the pneumatic cylinder 56. A compression spring 66 surrounds the piston rod 65 inside the cylinder 56 and is supported, at its opposite ends, against a rear surface of the piston 64 and the bottom of the cylinder 56, respectively. The free end of the piston 65, which is located outside of the cylinder 56, is connected with the pivotable blocking hook 58. The blocking hook 58 has an angular shape and pivots about an axle 67. The axle 67 extends transverse to the longitudinal extent of the piston rod 65. At its end opposite the end connected with the piston rod 65, the blocking hook 58 has a nose 68 facing the guide cylinder 5. The nose 68 is displaced into the path of the movement of the drive ring 28 when the blocking hook 58 pivots about the axle 67 in the clockwise direction. When the nose 68 is located in the path of the movement of the drive ring 28, the compression springs supported on the drive rods 23 cannot push the drive ring 28 away from the bottom 3. As a result, the inlet/outlet valves 26 remain closed.

The closing takes place after the ignition of the fuel gas mixture which increases the pressure in the combustion chamber 1. The increased pressure is communicated, via the check valve 55, to the cylinder 56. This results in the displacement of the piston 64 against the biasing force of the spring 66. Upon the displacement of the piston 64, the piston rod 65 pivots the blocking hook 58 about the axle 67 in the clockwise direction, and the nose 68 engages the drive ring 28 from beneath. With a further increase of the pressure in the combustion chamber 1, an increased pressure is applied to the piston 64, retaining it in the position in which the nose 68 blocks the drive ring 28. When the pressure in the combustion chamber 1 reaches its maximum and then diminishes, the check valve 55 remains closed as the pressure in the conduit 59 is smaller than in the channel 62. At that, the blocking device 54 acts as an accumulator, and the blocking of the drive ring 28 is maintained, resulting in maintaining of the locking of the valves 26 and the movable wall 14. The pressure in the channel 62 is reduced, via the throttle 57, gradually or over a predetermined time period determined by the adjusted cross-section of the throttle 57. When the pressure in the channel 62 is reduced below a certain value, the spring 66 biases the piston 64 in a direction toward the check valve 55, pulling the piston rod 65 with it. Upon the piston rod 64 being pulled toward the check valve 55, the blocking hook 58 would pivot in the counterclockwise direction about the axle 67, withdrawing the nose 68 from the displacement path of the drive ring 28. The drive ring 68 can now displace away from the bottom 3, which results in the opening of the valves 26 and the displacement of the movable wall 14, together with the separation plate 18, toward the bottom 3, with the waste gases being expelled from the chamber sections 21, 22 through the openings 38 in the separation plate and the inlet/outlet valves 26, respectively.

Below, the operation of the tool according to the present invention will be discussed in detail with reference to FIGS. 2–5. In FIGS. 2–5, the same element as those in FIG. 1 are designated with the same reference numerals.

Figure 2:
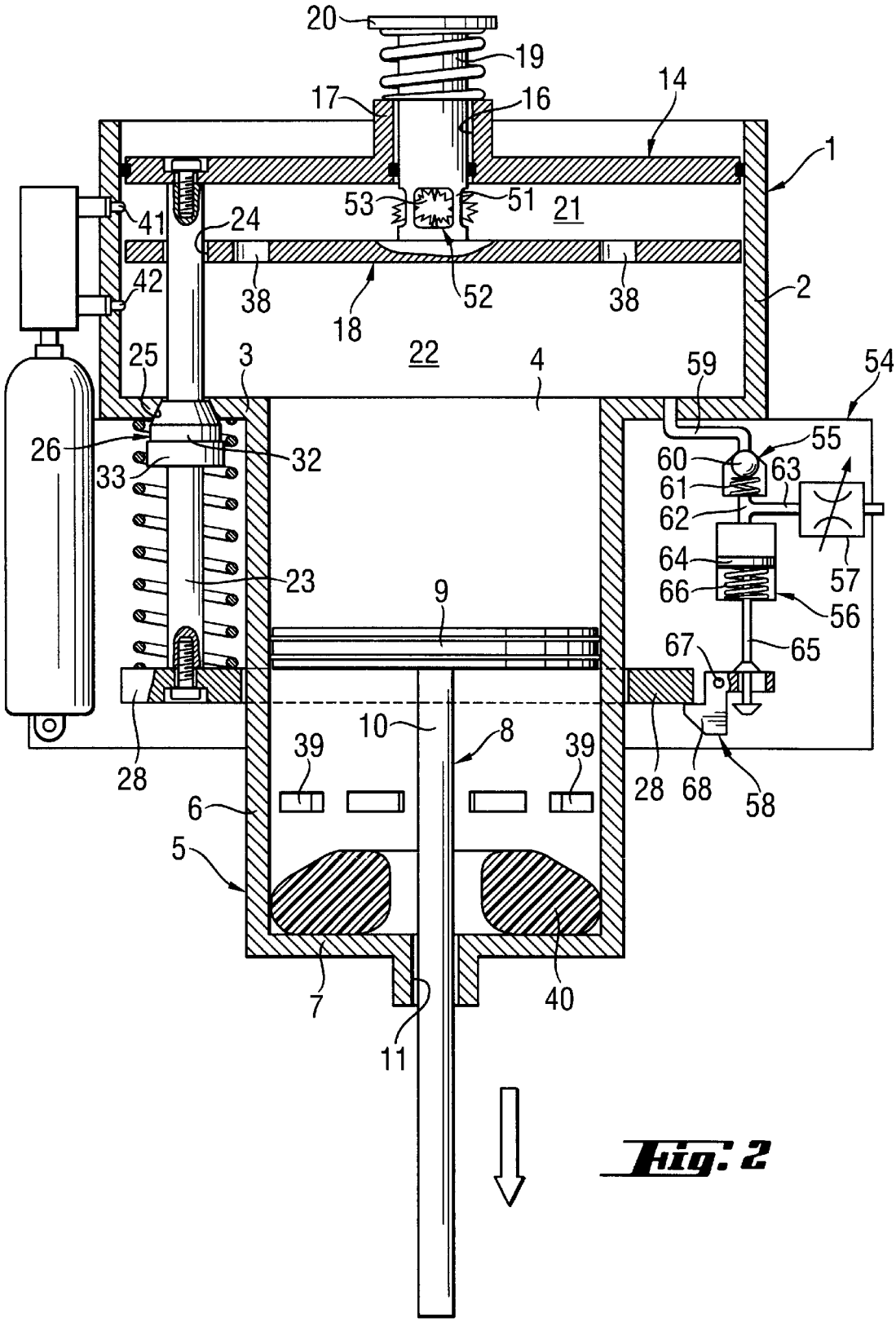
FIG. 2 shows a cross-sectional view of the tool shown in FIG. 1 in a condition after ignition, with the movable walls being locked in their positions and the piston being displaced.

FIG. 2 practically corresponds to FIG. 1, only in FIG. 2, the ignition device 52 has already been actuated by a trigger or a lever (not shown). Upon actuation of the ignition device 52, a spark is generated in the cage 51. After the ignition, an air-fuel gas mixture starts to bum laminary in the forechamber section 21. Upon ignition of the mixture, a flame front starts to propagate radially with a relatively small velocity. The flame front pushes the unconsumed air-fuel gas mixture ahead of itself, and the unconsumed air-fuel gas mixture penetrates through the through-openings 38 in the separation plate 18 into the main combustion chamber section 22, creating there turbulence and pre-compression.

As the flame front reaches the through-openings 38, flame penetrates therethrough, due to the small cross-section of the openings 38, in a form of flame jets into the main chamber section 22, creating there a further turbulence. The thoroughly intermixed air-fuel gas mixture in the main chamber section ignites over the entire surface of the flame jets. The mixture bums with a high speed which leads to a sharp increase of the pressure in the main chamber section 22.

The high pressure, which is generated in the main chamber section 22, is transmitted, on one hand, to the piston 8 and, on the other hand, via the check valve 55, to the piston 64 of the pneumatic cylinder 56. The piston 64, together with the piston rod 65, is displaced away from the check valve 55, compressing the spring 66. The free end of the piston rod 65 pivots the blocking hook 58 about the axle 67 in the clockwise direction, whereby the nose 68 is displaced into the displacement path of the drive ring 28. Thereby, a locking condition is obtained.

Simultaneously with the increase of pressure in the main chamber section 22, the piston 8 moves with a high speed toward the bottom 7 of the guide cylinder 5, forcing the air from the guide cylinder 5 out through the openings 39. Upon the piston plate 9 passing the openings 39, the exhaust gas is discharged therethrough. The piston rod 10 effects setting of a fastening element, being displaced in the direction shown by arrow. As in the course of movement of the piston 8, the pressure in the main chamber section 22 decreases, resulting in the decrease of pressure in the conduit 59. Because a maximum pressure has been stored in the channel 62, the check valve 55 remains closed. The throttle 57 provides only for a very slow reduction of pressure in the channel 62, and the locking condition is still maintained.

Figure 3:
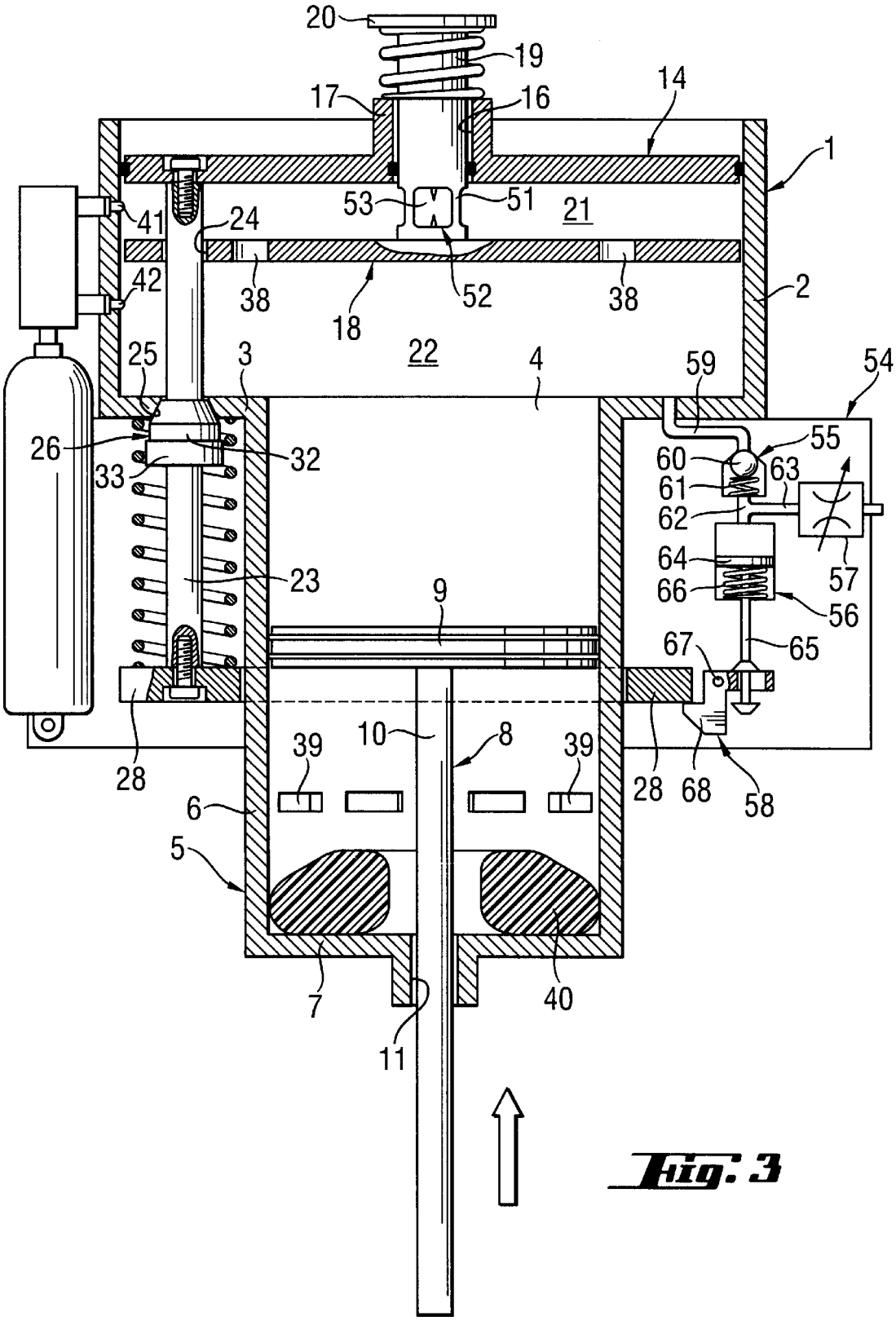
FIG. 3 show a view similar to that of FIG. 2 but with the piston on its way to its initial position.

After setting or following the combustion of the air-fuel gas mixture, the piston 8 is brought to its initial position, as is shown in FIG. 3, as a result of thermal feedback produced by cooling of the flue gases which remain in the combustion chamber 1 and the guide cylinder 5. As a result of cooling of the flue gases, an underpressure is created behind the piston 8 which provides for return of the piston 8 to its initial position. The combustion chamber 1 should remain sealed until the piston 8 reaches its initial position shown in FIG. 1. This means that the locking condition should remain, which is insured in a manner described above with reference to FIG. 2. The locking condition in FIG. 3 has not changed in comparison with that in FIG. 2.

Figure 4:
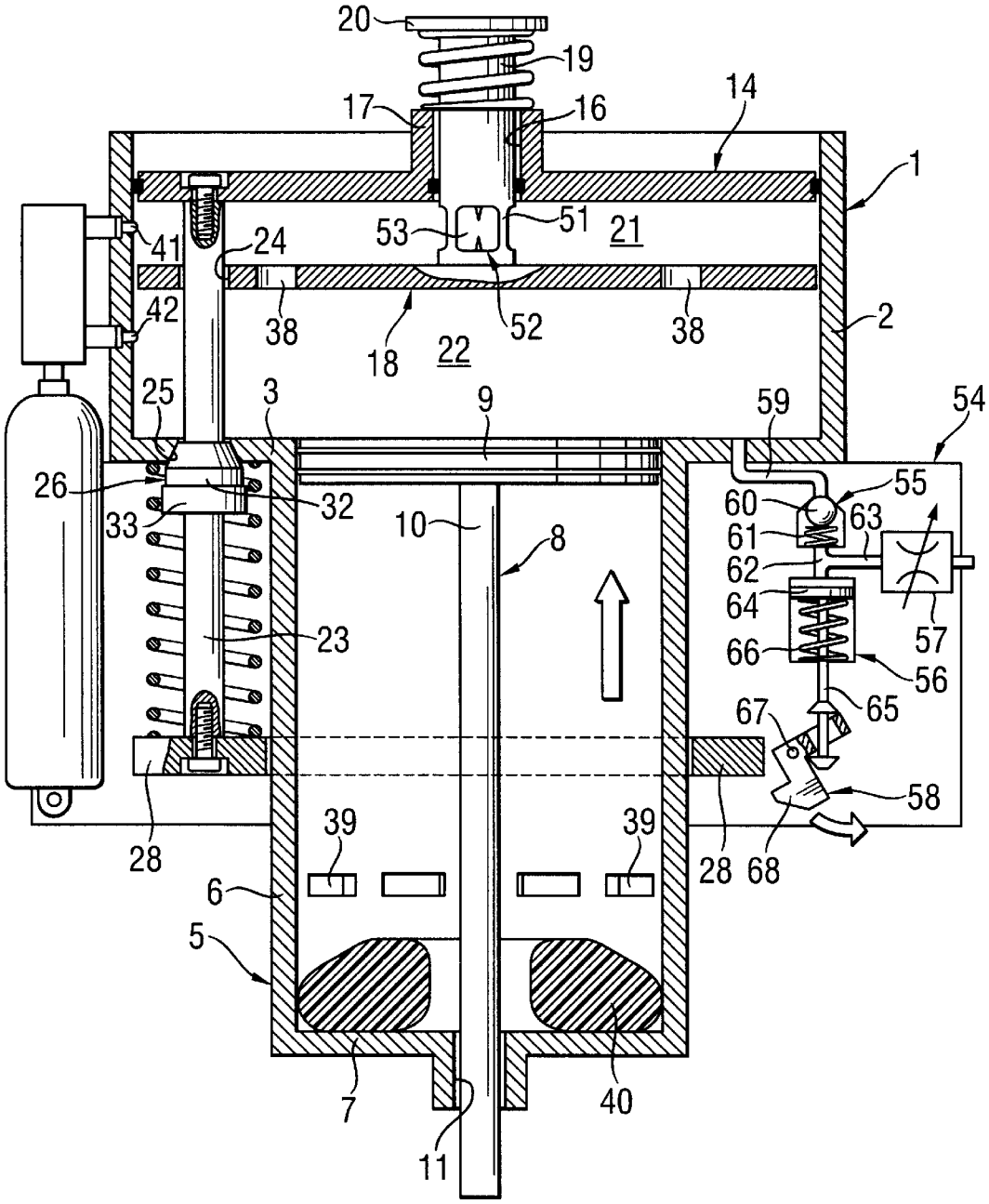
FIG. 4 shows a view similar to that of FIG. 1 with unlocked movable walls.
Figure 5:
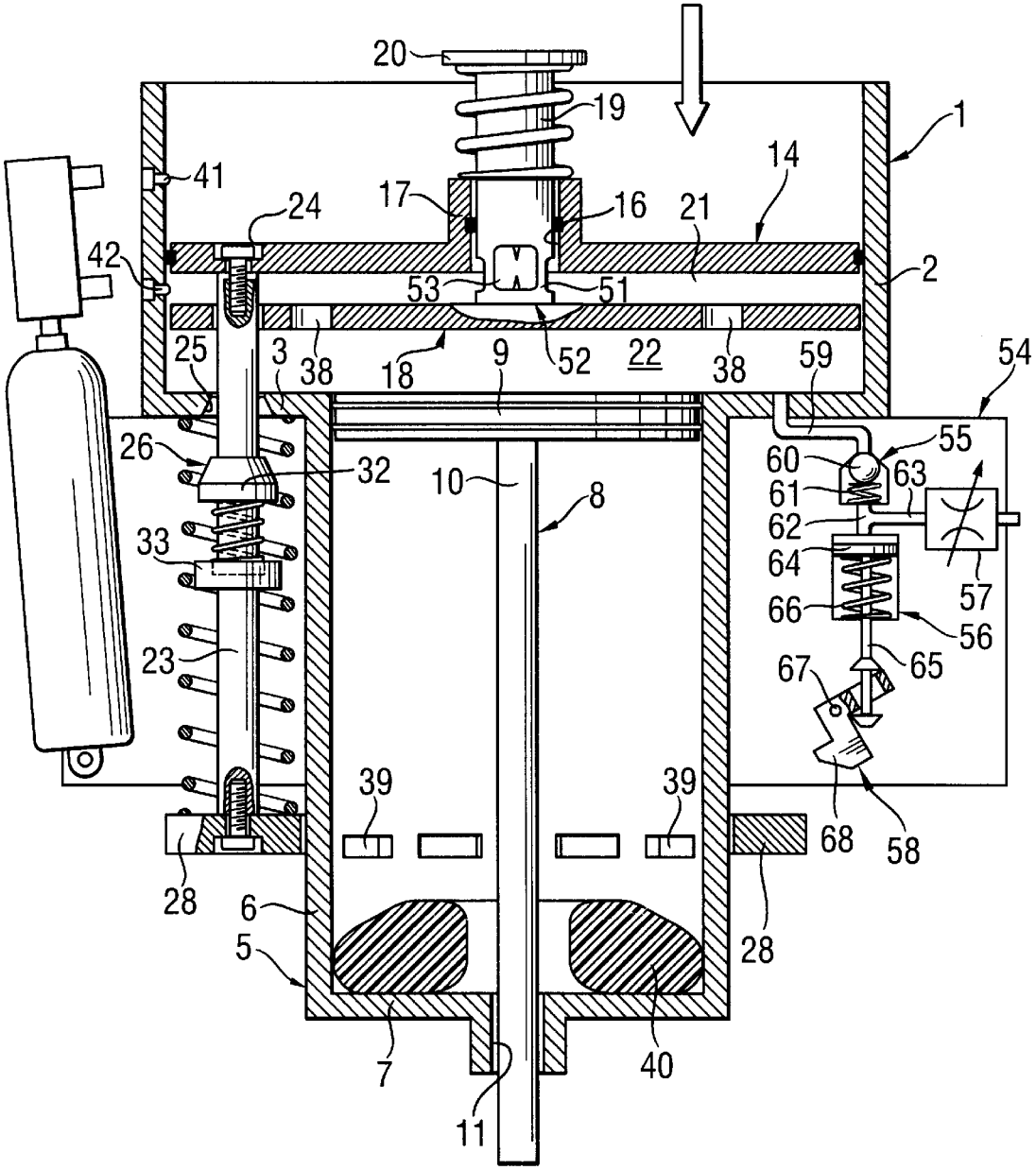
FIG. 5 shows a cross-sectional view of the tool in the region of its combustion chamber, with the piston in its initial position and the chambers sections in their collapsed condition.

FIG. 4 shows a condition at which the piston 8 is brought to its initial position as a result of thermal feedback. The operation of the throttle 57 is so adjusted that only after the piston 8 is brought into is initial position, the pressure in the channel 62 is reduced to an extent at which the spring 66 is able to displace the piston 64 in a direction toward the check valve 55. With the piston rod 65 movable together with the piston 64, the blocking hook 58 pivots about the axle 67 in the counterclockwise direction, with the nose 68 being displaced out of the displacement path of the drive ring 28.

Upon removal of the blocking hook 58 out of the displacement path of the drive ring 28, the compression springs supported on the drive rods 23 displace the drive ring 28 away from the bottom 3 of the combustion chamber 1, opening the inlet/outlet valves 26. Simultaneously, the movable wall 14 is displaced toward the bottom 3, entraining therewith the separation plate 18, with the waste gases being discharged from the forechamber section 21 and the main chamber section 22 through the openings 38 in the separation plate 18 and the valves 26, respectively. Upon subsequent expansion of the forechamber section 21 and the main chamber section 22, as a result of the movement of the drive ring 28 in opposite direction, the air is aspirated into the main chamber section 22 and the forechamber section 21 through the inlet/outlet valves 26 and the through-openings 28 in the separation plate 18, respectively.

Although the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirits and scope of the present invention as defined by the appended claims.

What is claimed is:

1. A portable, combustion-engined tool, comprising a combustion chamber (1); an inlet/outlet valve (26) provided in the combustion chamber (1); blocking means (54) providing for closing and opening the inlet/outlet valve (26); and means for controlling operation of the blocking means (54) dependent on a gas pressure developed in the combustion chamber, wherein the blocking means (54) comprises a pneumatic device, and wherein the blocking means (54) further comprises a check valve (55) connected with the combustion chamber (1); and a conduit (62) connecting the check valve (55) with a pneumatic cylinder (56) of the pneumatic device; and wherein the controlling means comprises a throttle (57) for communicating the conduit (62) with a surrounding atmosphere.

2. A tool according to claim 1, wherein the blocking means (54) comprises a blocking member (58), and the pneumatic device comprises a piston (64) displaceable in the pneumatic cylinder (56) and having a piston rod (65) connected with the blocking member (58) for pivoting same between blocking and release positions thereof.

3. A portable, combustion-engined tool, comprising a combustion chamber (1); an inlet/outlet valve (26) provided in the combustion chamber (1); blocking means (54) providing for closing and opening the inlet/outlet valve (26); and means for controlling operation of the blocking means (54) dependent on a gas pressure developed in the combustion chamber, wherein the tool further comprises a drive ring (28) for effecting closing and opening of the inlet/outlet valve (26); and the blocking means (54) comprises means for blocking the drive ring (28).

4. A portable, combustion-engined tool, comprising a combustion chamber (1); an inlet/outlet valve (26) provided in the combustion chamber (1); blocking means (54) providing for closing and opening the inlet/outlet valve (26); and means for controlling operation of the blocking means (54) dependent on a gas pressure developed in the combustion chamber, wherein the combustion chamber (1) is formed as a collapsible chamber having a plurality of walls (14, 18) displaceable along a longitudinal extent of the combustion chamber (1); and wherein the blocking means (54) provides for locking of the displaceable walls of the combustion chamber in predetermined positions thereof and for release of the displaceable walls.

5. A method of controlling operation of a portable, combustion-engined tool including a combustion chamber (1) an inlet/outlet valve (26) of which is closed or is opened dependent on an operational phase of the tool, and a piston (8) displaceable from an initial position thereof into an operational position thereof upon creation of overpressure in the combustion chamber and returning into the initial position thereof upon creation of underpressure in the combustion chamber, the method comprising the steps of igniting a fuel gas mixture filling the combustion chamber (1) for build-up of gas pressure therein; and closing or opening the inlet/outlet valve (26) dependent on the gas pressure developed in the combustion chamber (1), wherein locking of the valve (26) in a closing position thereof starts after an overpressure has been created in the combustion chamber (1), and wherein release of the valve (26) starts after an expiration of a predetermined time period after an overpressure has been developed in the combustion chamber.

6. A method according to claim 5, when the predetermined time period starts at a moment a maximum gas pressure has been developed in the combustion chamber.

7. A portable combustion-engined tool, comprising a combustion chamber (1); a piston (8) displaceable from an initial position thereof into an operational position thereof upon creation of overpressure in the combustion chamber and returning into the initial position thereof upon creation of underpressure in the combustion chamber, an inlet/outlet valve (26) provided in the combustion chamber (1); and means for controlling opening and closing of the inlet/outlet valve (26), the controlling means including sensor means (55) for detecting overpressure in the combustion chamber and for locking the inlet/outlet valve in a closed position thereof when the overpressure in the combustion chamber is detected, and time-delay means that provides for release of the inlet/outlet valve upon expiration of a determined time period after the overpressure has been developed in the combustion chamber.

* * * * *